US006168406B1

(12) United States Patent
Tseng

(10) Patent No.: US 6,168,406 B1
(45) Date of Patent: Jan. 2, 2001

(54) YARN-FORMING FILAMENT COOLING APPARATUS

(76) Inventor: Ching-Kun Tseng, 34, 112 Lane, Sy Yuan Rd., Hsin Chuang Taipei County (TW)

( * ) Notice: Under 35 U.S.C. 154(b), the term of this patent shall be extended for 0 days.

(21) Appl. No.: 09/199,314

(22) Filed: Nov. 25, 1998

(51) Int. Cl.[7] ..... D01D 5/092
(52) U.S. Cl. ..... 425/72.2; 425/378.2; 425/445; 264/211.5
(58) Field of Search ..... 425/72.2, 192 S, 425/378.2, 382.2, 445; 264/211.14, 211.15, 211.17

(56) References Cited

U.S. PATENT DOCUMENTS 3,108,322 * 10/1963 Tate ..... 18/8
3,936,253 * 2/1976 Fisher et al. ..... 425/72 S
5,173,310 * 12/1992 Katou et al. ..... 425/72.2
5,262,110 * 11/1993 Spaller, Jr. et al. ..... 264/207

* cited by examiner

*Primary Examiner*—Harold Pyon
*Assistant Examiner*—Joseph S. Del Sole
(74) *Attorney, Agent, or Firm*—Dougherty & Troxell

(57) ABSTRACT

Disclosed is a yarn-forming filament cooling apparatus mainly including a stand-up air compartment defining a cooling air channel and a quick-cooling air-converge compartment located above the cooling air channel. Inner tubes are provided in the air-converge compartment corresponding to filament guiding ports provided on a top of the cooling air channel. Each inner tube is provided on a circumferential surface with a plurality of throttle pores, such that when filaments are directed to pass filament guiding ports and inner tubes at high speed, air flowing through the cooling air channel is radially drawn into inner tubes to cool the filaments in all directions while the filaments keep moving forward at full speed. Meanwhile, cooling air is supplied into an upper portion of the air-converge compartment in horizontally opposite directions without producing lateral resistance to the moving filaments. Whereby, high yield rate of yarns with stable quality can be achieved.

5 Claims, 6 Drawing Sheets

YARN-FORMING FILAMENT COOLING APPARATUS

BACKGROUND OF THE INVENTION

The present invention relates to improvements made to the cooling of filaments for forming yarns, and more particularly to a yarn-forming filament cooling apparatus that enables filaments to be cooled in all directions while passing the cooling apparatus at full speed. Yarns produced with evenly cooled filaments shall have stable quality and increased yield rate.

It is known that the quality of filaments for forming yarns has direct influence on the quality of finished products and has close relations with chemicals and temperature control in the production environment. Earlier yarns produced had higher denier and inferior quality due to incomplete manufacturing equipment and techniques than yarns currently produced. Following the increasingly improved equipment and techniques, fine yarns having a diameter about 0.003 mm can be produced at much higher speed than ever before. However, it is still an important object of textile industry to achieve high yield rate of fine yarns having a more stable quality.

In a conventional yarn-forming filament cooling apparatus, there is a quick cooling chamber in which one-direction cooling air is supplied to blow and cool filaments passing therethrough, as shown in FIG. 6. Following disadvantages are found in such conventional cooling apparatus and require improvement:

1. Filaments pass the quick cooling chamber at a speed as high as 3000 to 7000 meters per minute. When the filaments are subjected to the one-direction air while moving forward, they tend to be shifted to one side and have different temperatures at two sides thereof. Such difference in the temperature of filaments adversely affects the stability of yarns.
2. The one-direction air causes the filaments to shift laterally toward one side that would stop filaments from forming stable yarns. The good yield rate of yarns is low.

SUMMARY OF THE INVENTION

It is therefore a primary object of the present invention to provide a yarn-forming filament cooling apparatus that enables cooling of filaments for forming yarns in all directions to obtain yarns of stable quality, particularly yarns of super low denier.

Another object of the present invention is to provide a yarn-forming filament cooling apparatus- that would not obstruct smooth moving of filaments therein to allow significantly increased yield rate.

To achieve the above and other objects, the yarn-forming filament cooling apparatus of the present invention mainly includes a stand-up air compartment defining a cooling air channel and a quick-cooling air-converge compartment located at an upper portion of the stand-up air compartment. Inner tubes are provided in the quick-cooling air-converge compartment corresponding to filament guiding ports provided on top of the cooling air channel. Each inner tube is provided on a circumferential surface with a plurality of throttle pores, such that when filaments are directed to pass filament guiding ports and inner tubes at high speed, air flowing through the cooling air channel is radially drawn into inner tubes to cool the filaments in all directions while the filaments keep moving forward at full speed. Meanwhile, cooling air is supplied in horizontally opposite directions and supplied into an upper portion of the air-converge compartment without producing lateral resistance to the moving filaments. Whereby, high yield rate of yarns with stable quality can be achieved.

BRIEF DESCRIPTION OF THE DRAWINGS

The structure of the present invention can be best understood by referring to the following detailed description of the preferred embodiments and the accompanying drawings, wherein.

DETAILED DESCRIPTION OF THE PREFERRED EMBODIMENTS

Figure 1:
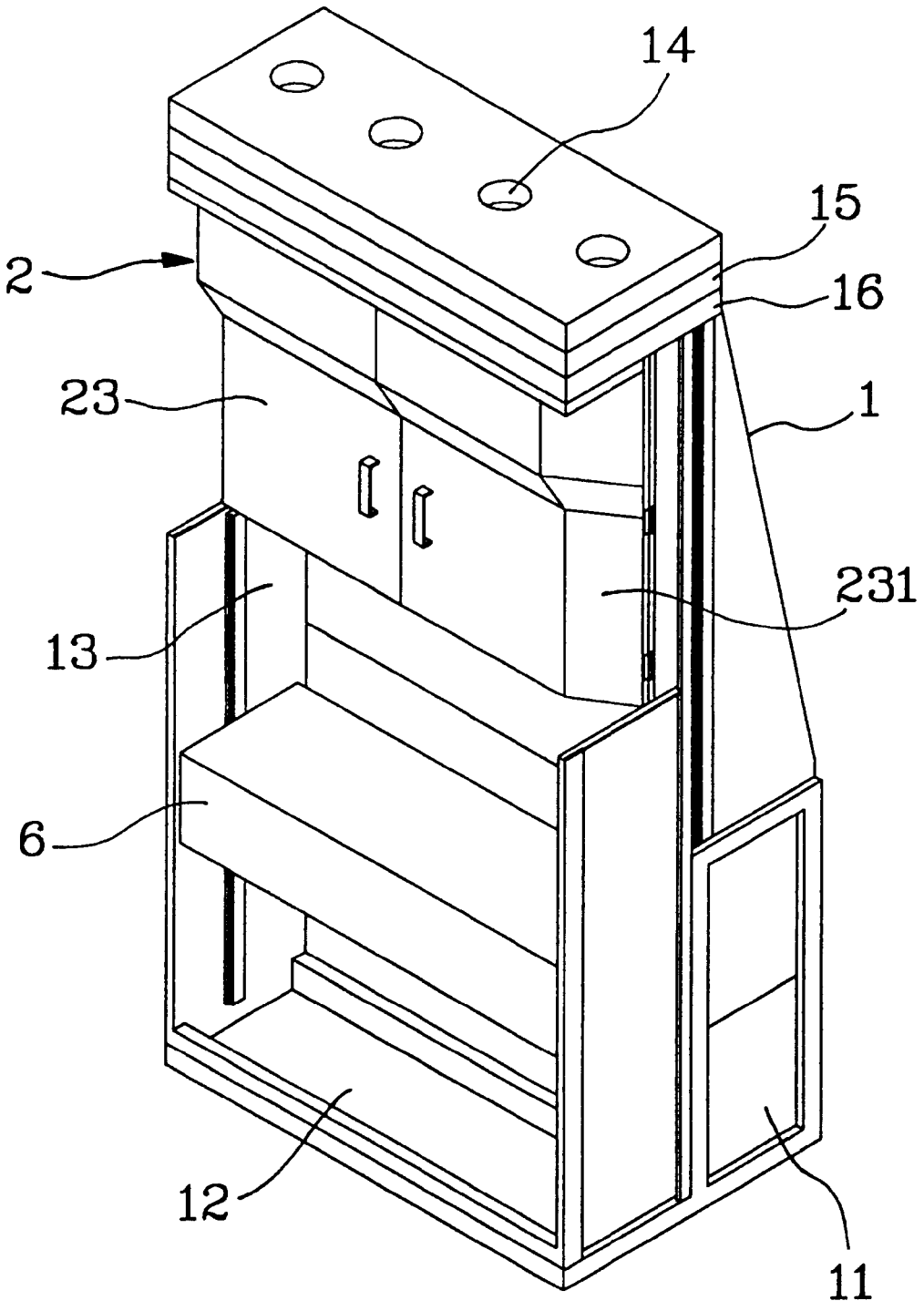
FIG. 1 is a perspective of the yarn-forming filament cooling apparatus of the present invention.

Please refer to FIG. 1 in which a yarn-forming filament cooling apparatus according to the present invention is shown. The yarn-forming filament cooling apparatus mainly includes a stand-up air compartment 1 and a quick-cooling air-converge compartment 2.

The stand-up air compartment 1 defines a cooling air channel 13 therein with an air inlet 11 provided at one lateral side thereof and an air outlet 12 at a front side thereof. A plurality of filament guiding ports 14 are formed at a top of the stand-up air compartment 1. Heater 15 and insulating material 16 are provided around the filament guiding ports 14.

Figure 2C:
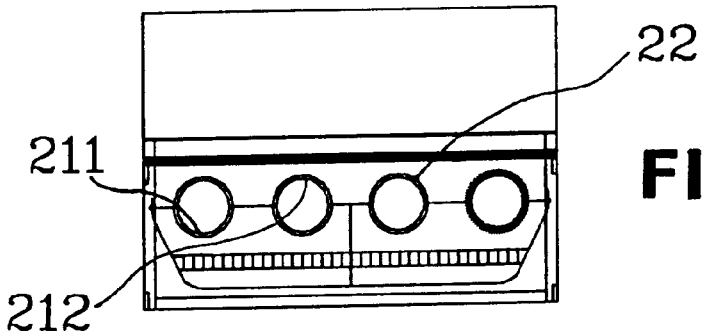
FIGS. 2A–C includes front elevation, side elevation, and top plan view of the present invention.
Figure 2A:
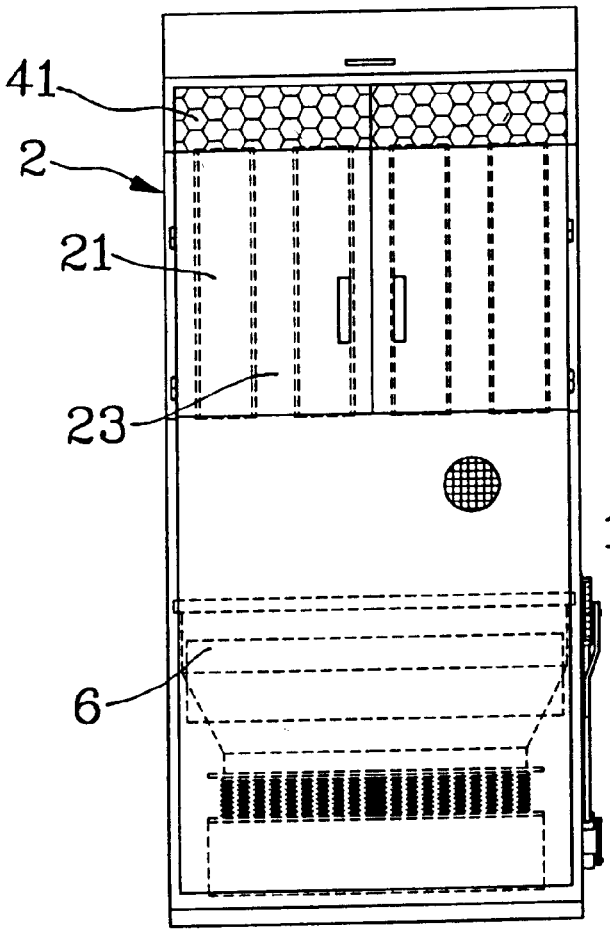
Figure 2B:
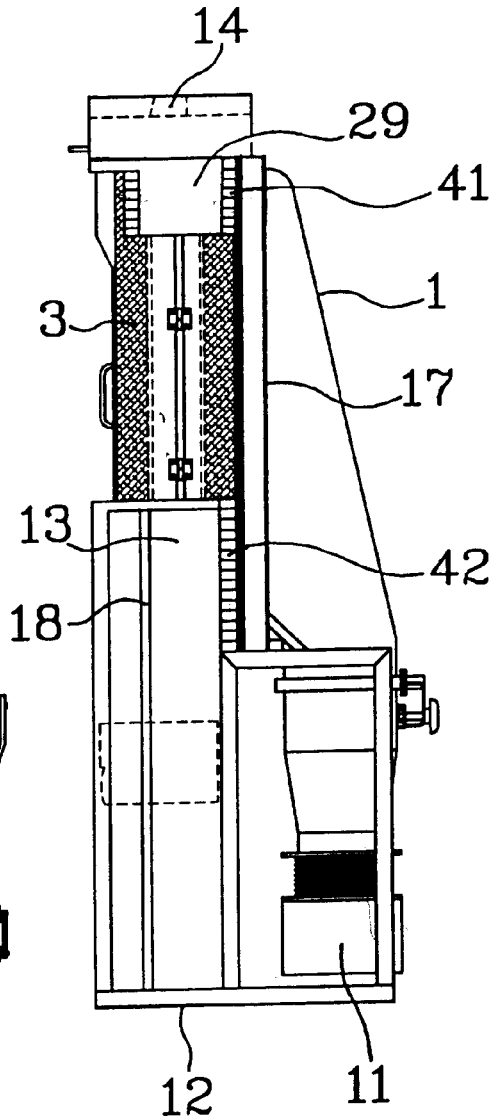

Please refer to FIG. 2 that shows front elevation, side elevation, and top plan view of the present invention. As shown, the quick-cooling air-converge compartment 2 is located above the cooling air channel 13 of the stand-up air compartment 1 and includes four inner tubes 21. Each inner tube 21 has a plurality of throttle pores 22 provided on a circumferential surface thereof for air to pass therethrough.

Figure 3:
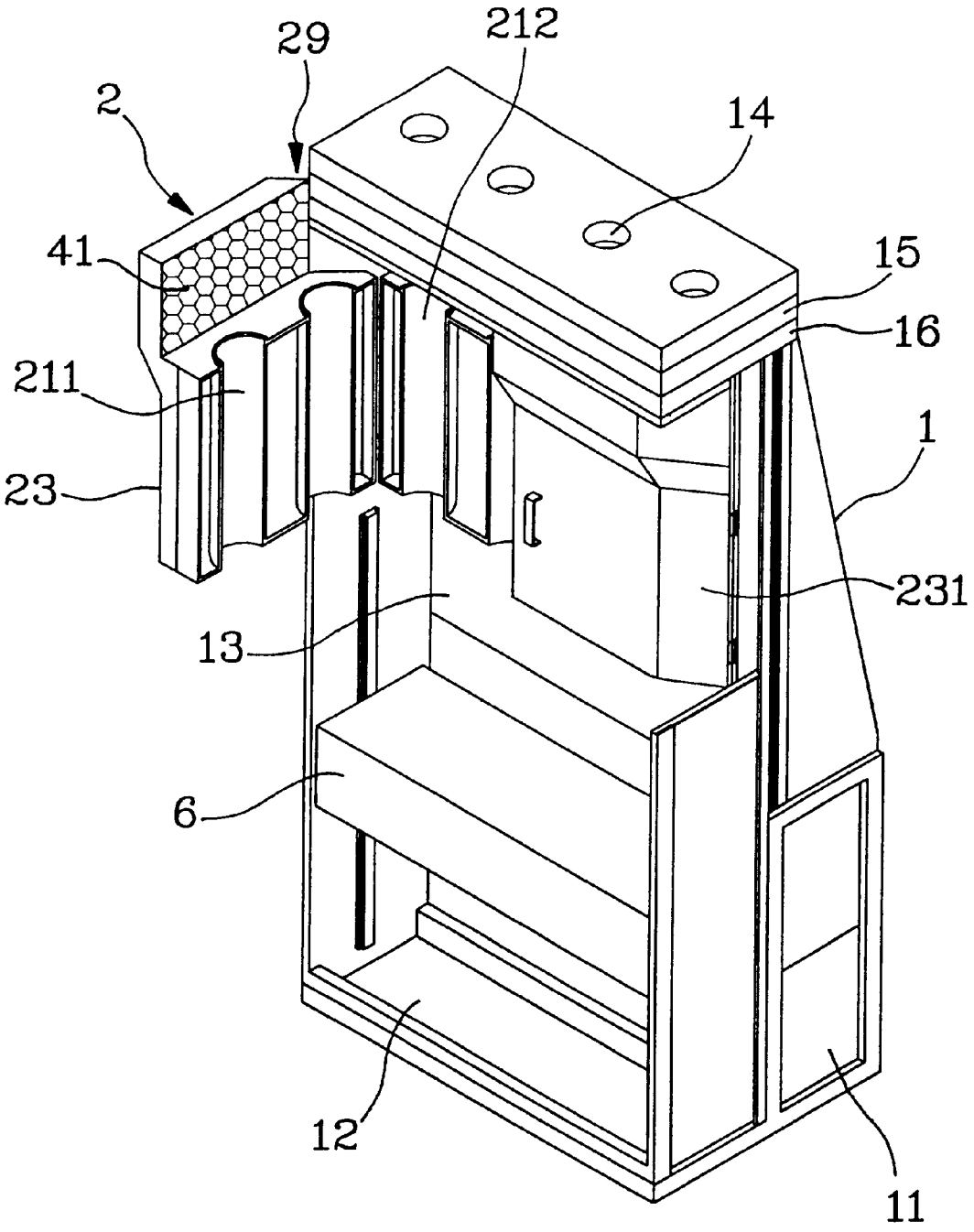
FIG. 3 is a perspective of the present invention with a hinged door thereof in an opened position.
Figures 4A, 4B:
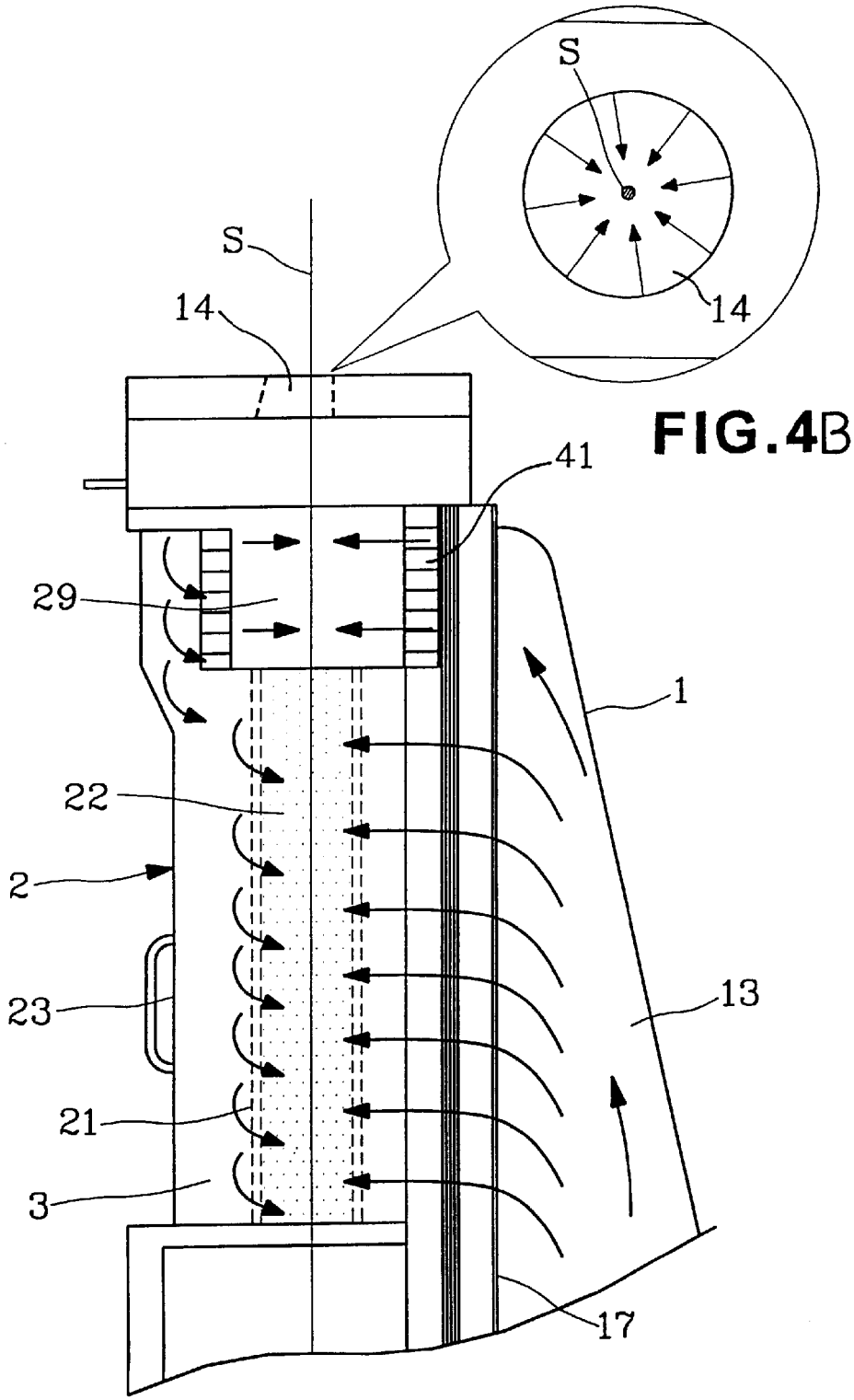
FIGS. 4A–B illustrates the operation of the present invention.

As can be more clearly seen from FIG. 3, the air-converge compartment 2 is provided at a front surface with two hinged doors 23 that can be pivotally pulled outward to expose the inner tubes 21. The inner tube 21 each is formed from two half-tubes 211, 212 correspondingly formed on inner surfaces of the doors 23 and a back wall of the air-converge compartment 2. Each door 23 has two half-tubes 211. Filter 3 is provided to wrap around outer surface of each inner tube 21, so that only clean air without impurities is allowed to enter inner tubes 21 without breaking filaments S that pass through inner tubes 21 for cooling purpose.

The filaments S move forward to pass inner tubes 21 at a speed of 3000 to 7000 meters per minute and therefore produce following air flows in the inner tubes 21 at the same time. Cold air in the cooling air channel 13 is drawn into inner tubes 21 by the following air flows after passing through filters 3 and throttle pores 22. The clean cold air keeps blowing radially on the filaments S, so that filaments S are subjected to even and uniform cooling air in all directions. Yarns produced from so evenly cooled filaments shall have stable quality and are suitable for easy process by downstream textile manufacturers.

Please go back to FIGS. 2 and 3. A secondary cooling air chamber 29 may be provided between the filament guiding ports 14 and upper ends of the inner tubes 21. Clean and dry air is supplied into the secondary cooling chamber 29 in horizontally opposite directions to cooperate with the air radially drawn into the inner tubes 21 to achieve enhanced cooling effect. This design allows the filaments S guided into the yarn-forming filament cooling apparatus of the present invention to move through the cooling air channel 13 at full speed without being obstructed by any lateral force from the air. The problem of reduced moving speed of filaments S existed in the conventional yarn-forming filament cooling apparatus can be avoided to obtain significantly increased productivity.

Figure 5:
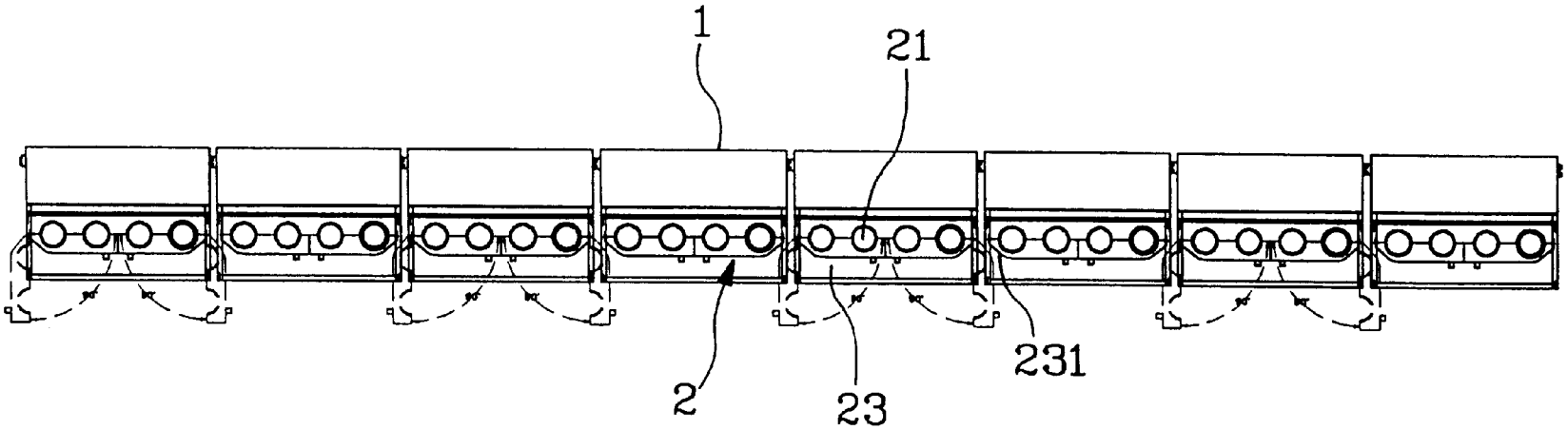
FIG. 5 illustrates the manner to open the hinged doors when multiple units of the present invention are parallelly arranged.
Figure 6:
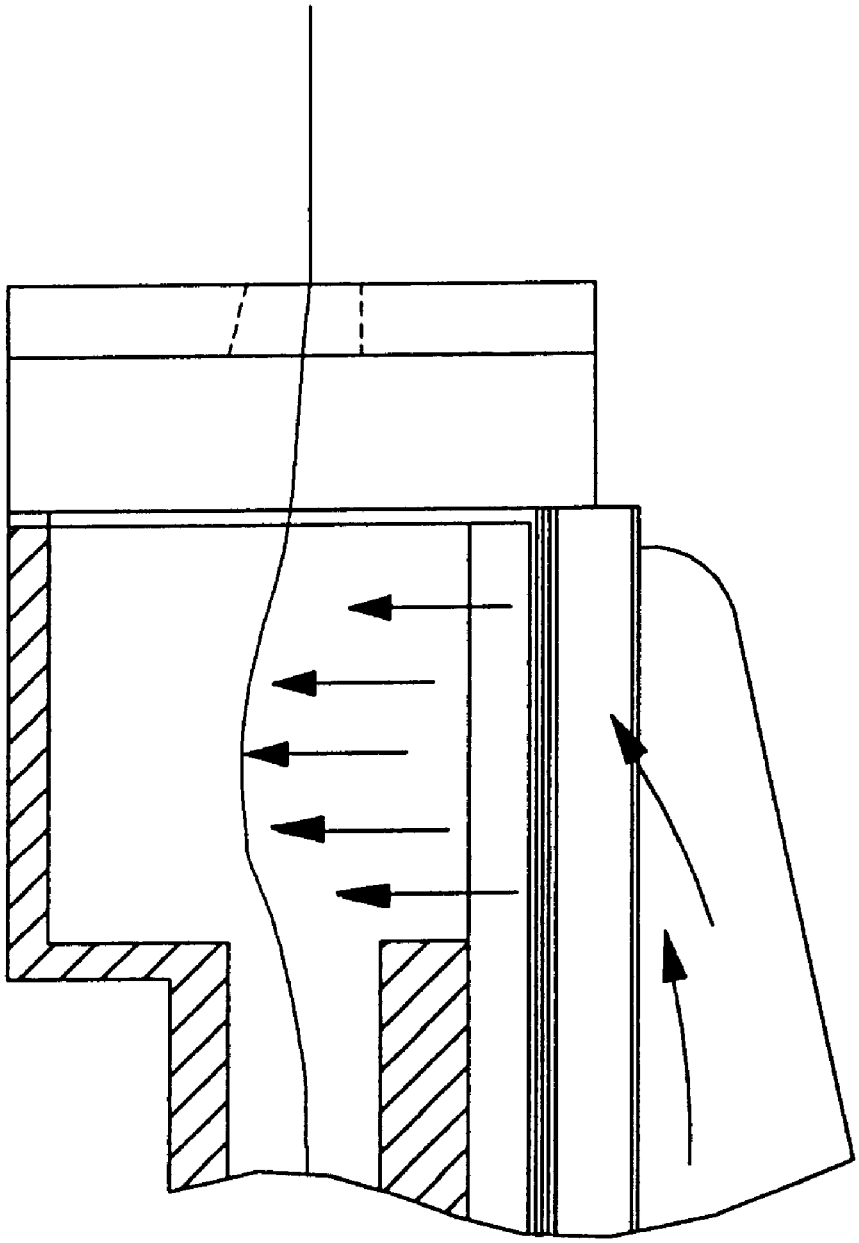
FIG.6 PRIOR ART
FIG. 6 is a fragmentary side sectional view illustrating the operation of a conventional yarn-forming filament cooling apparatus.

As can be viewed from FIGS. 2 and 3, the cooling air channel 13 of the stand-up air compartment 1 extends upward and then turns to the front side of the stand-up air compartment 1. A big piece of filter 17 located at the turning serves as a partition to divide the cooling air channel 13 into a front and a rear part. Honey-comb material 41 is provided around upper inner surfaces of the air-converge compartment 2 to cooperate with the big piece of filter 17 to form the secondary cooling chamber 29. The filters 3 wrap the half-tubes 211, 212 forming the inner tubes 21. Honey-comb material 42 is provided between the front and the rear parts of the cooling air channel 13 to face another big piece of filter 18 erected in the front part of the cooling air channel 13. A filament process mechanism 6 is arranged in the stand-up air compartment 1 at a lower portion thereof at a suitable position. And, as shown in FIG. 5, multiple units of the yarn-forming filament cooling apparatus of the present invention can be parallelly arranged to occupy reduced room. To facilitate opening of doors 23 of these parallelly arranged cooling apparatus for internal cleaning and other purposes, a portion 231 on an outer surface of each door 23 near a hinged edge of the door 23 is chamfered to avoid collision of an opened door 23 with an adjacent cooling apparatus.

With the above described arrangements, the yarn-forming filament cooling apparatus according to the present invention effectively cools filaments in all directions and therefore enables production of yarns having stable quality. Moreover, the yarn-forming filament cooling apparatus allows filaments to pass therethrough at full speed without obstruction and can therefore create increased industrial value and economic benefits.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A yarn-forming filament cooling apparatus comprising:

a stand-up air-compartment defining a cooling air channel and having an air inlet at a lateral side, an air outlet at a front side, and a plurality of filament guiding posts at a top thereof; and a quick-cooling air-coverage compartment located above said cooling air channel of said stand-up air compartment and including a plurality of axially extended inner tubes corresponding to said filament guiding posts, each of said inner tubes being provided with a plurality of throttle pores on a circumferential surface of said inner tubes, for external air to enter into said inner tubes;

whereby when filaments for forming yarns are directed to pass said filament guiding ports and enter into said inner tubes, air flowing through said cooling air channel is radially drawn into said inner tubes to evenly cool said filaments in all directions.

2. A yarn-forming filament cooling apparatus as claimed in claim 1, further comprising a secondary cooling air chamber located at an upper portion of said air-converge compartment and below said filament guiding ports, and cooling air being supplied into said secondary cooling air chamber in horizontally opposite directions.

3. A yarn-forming filament cooling apparatus as claimed in claim 1 or 2, wherein said air-converge compartment is provided with movable doors, and wherein each of said inner tubes is formed from two half-tubes separately but correspondingly formed on inner surfaces of said doors and of a back wall of said air-converge compartment, and each of said half-tubes being wrapped with filters.

4. A yarn-forming filament cooling apparatus as claimed in claim 3, wherein said movable doors of said air-converge compartment are two hinged doors that can be pivotally pulled outward to open, and portions on outer surfaces of said doors near hinged edges thereof being chamfered to facilitate open of said doors when more than one unit of said cooling apparatus is parallelly arranged, and wherein said half-tubes separately formed on inner surfaces of said doors are in the same numbers.

5. A yarn-forming filament cooling apparatus as claimed in claim 3, wherein said filament guiding ports of said stand-up air compartment have heater and insulating material wrapped therearound, said cooling air channel extending upward and turning forward to form a rear and a front part with a piece of filter provided between these two parts, said air-converge compartment being provided at upper inner surface with honey-comb material, and said front part of said cooling air channel being provided at a back side with honey-comb material and a front side with a piece of filter facing said honey-comb material and said honey-comb material and said piece of filter form said secondary cooling chamber, and wherein a filament process mechanism is provided in said cooling air channel at a lower portion thereof.

* * * * *